US005286061A

United States Patent [19]

Behm. William F.

[11] Patent Number: 5,286,061

[45] Date of Patent: Feb. 15, 1994

[54] LOTTERY TICKET HAVING VALIDATION DATA PRINTED IN DEVELOPABLE INVISIBLE INK

[75] Inventor: Behm. William F., Marietta, Ga.

[73] Assignee: Scientific Games, Inc., Alpharetta, Ga.

[21] Appl. No.: 958,999

[22] Filed: Oct. 9, 1992

[51] Int. Cl.[5] ..... B42D 15/00

[52] U.S. Cl. ..... 283/95; 283/96; 283/102; 283/901; 283/903

[58] Field of Search ..... 283/94, 95, 96, 97, 283/98, 102, 902, 903

[56] References Cited

U.S. PATENT DOCUMENTS

| | | | |
|---|---|---|---|
| 2,410,800 | 11/1946 | Baumgartner . | |
| 2,764,821 | 10/1956 | Buitenkant . | |
| 2,961,777 | 11/1960 | Neville et al. . | |
| 3,351,005 | 11/1967 | Giori . | |
| 3,363,336 | 1/1968 | Skinner . | |
| 3,473,807 | 10/1969 | Leonard | 283/94 X |
| 3,508,344 | 4/1970 | Thomas . | |
| 3,682,673 | 8/1972 | Manske | 283/95 X |
| 3,788,863 | 1/1974 | Scheuer . | |
| 3,823,022 | 7/1974 | Thomas . | |
| 3,826,499 | 7/1974 | Lenroff | 283/95 X |
| 4,037,007 | 7/1977 | Wood . | |
| 4,087,092 | 5/1978 | Krausse et al. . | |
| 4,109,047 | 8/1978 | Frederickson . | |
| 4,120,445 | 10/1978 | Carrier et al. . | |
| 4,174,857 | 11/1979 | Koza . | |
| 4,188,437 | 2/1980 | Rohowetz . | |
| 4,191,376 | 3/1980 | Goldman et al. . | |
| 4,273,362 | 6/1981 | Carrier et al. . | |
| 4,322,466 | 3/1982 | Tomlinson . | |
| 4,407,443 | 10/1988 | McCorkle . | |
| 4,457,430 | 7/1984 | Darling et al. . | |
| 4,486,033 | 12/1984 | Parrotta . | |
| 4,510,206 | 4/1985 | Shuman . | |
| 4,536,218 | 8/1985 | Ganho . | |
| 4,540,628 | 9/1985 | Oberdeck et al. . | |
| 4,585,254 | 4/1986 | Adams . | |
| 4,591,190 | 5/1986 | Clark . | |
| 4,725,079 | 2/1988 | Koza et al. . | |
| 4,726,608 | 2/1988 | Walton . | |

FOREIGN PATENT DOCUMENTS

| | | | |
|---|---|---|---|
| 2-243398 | 9/1990 | Japan | 283/901 |
| 2060491A | 5/1981 | United Kingdom . | |
| 2188283 | 9/1987 | United Kingdom | 283/903 |

*Primary Examiner*—Paul A. Bell
*Attorney, Agent, or Firm*—Jenner & Block

[57] ABSTRACT

A game ticket has validation data printed on the ticket substrate in invisible ink. The invisible validation data is capable of being irreversibly rendered visible by application of a developing agent. The ticket also has play indicia printed within the play area of the ticket and a removable layer affixed to the ticket over the game area.

47 Claims, 3 Drawing Sheets

LOTTERY TICKET HAVING VALIDATION DATA PRINTED IN DEVELOPABLE INVISIBLE INK

FIELD OF THE INVENTION

The present invention relates to the field of game tickets such as instant lottery tickets, and in particular to game tickets having validation codes.

BACKGROUND OF THE INVENTION

Instant lottery games do not require additional drawings or other events to determine the status of the ticket-holder as a winner or loser. Instead, the play indicia which determine the status of the ticket and can include numbers, symbols, letters, or combinations thereof are selected before the lottery tickets are sold. The list of winning status indicia may be publicly posted or printed on the individual tickets. In either event, an individual purchasing an instant lottery ticket may determine whether the ticket is a winner or loser within a few moments of purchasing the ticket.

The lottery tickets are printed with a set of play indicia which are used by the ticket holder to determine if the ticket has a winning combination which 4,241,942, 4,012,268, and 3,900,219 all disclose lottery tickets in which the play indicia are concealed before sale of the ticket. One method for concealing the play indicia includes an opaque removable layer affixed to the lottery ticket over the play indicia to conceal the play indicia. Various types of removable opaque layers are known in the art. One type of removable opaque layer consists of a coating which can be removed by rubbing or abrasion. U.S Pat. No. 4,725,079 discloses a removable latex cover which conceals the play indicia. U.S. Pat. Nos. 4,299,637 and 4,174,857 disclose a concealing layer consisting of cellulose acetate and latex. U.S. Pat. No. 4,726,608 discloses a concealing layer of a latex resin containing an ink and metal particles. U.S. Pat. No. 4,241,942 uses a removable coating of an elastomeric material to conceal the play indicia. A second type of removable opaque layers involves a separate sheet which is removed after tearing the sheet along perforated lines. U.S. Pat. No. 4,012,268 and U.S. Pat. No. 3,900,219 both disclose the use of this type of removable opaque layer. In all cases in which the play indicia are covered before sale of the ticket, after purchasing the ticket, the ticket holder removes the opaque layer to reveal the play indicia. The play indicia are then compared to the predetermined set of winning indicia to determine if the ticket holder is a winner. If the ticket has a winning set of indicia, the ticket holder then redeems the ticket in order to obtain the associated prize.

The manner in which prizes are distributed varies with the type of lottery game. Lotteries having high value prizes often require prize distribution by the lottery organizer or other designated clearing house. Other lotteries having low value prizes, such as many instant lottery games, frequently provide immediate prize distribution through the agent that sells the ticket.

Various means have been developed to prevent or detect falsification of lottery tickets for both high value and low value lotteries Unscrupulous individuals may try to alter a losing ticket by combining winning play indicia from a group of losing tickets. The unscrupulous individual may cut out winning play indicia and paste them together on a single ticket. Alternatively, the unscrupulous individual may attempt to forge the winning play indicia directly by printing or otherwise providing his own set of winning play indicia.

Validation codes have been developed to prevent this type of fraudulent practice. A validation code is a separate set of indicia that indicates whether the particular ticket was originally printed with winning or losing play indicia. Various types of validation codes are known in the art. U.S. Pat. No. 4,591,190 discloses a lottery ticket with a validation code which provides an entirely self-contained validation system. This validation system uses the play indicia themselves as the validation number. The play indicia are printed twice on the ticket. One set of the play indicia are clearly visible to the ticket holder and the second set is covered with a layer of scratch-off coating. When the ticket holder learns that the visible play indicia correspond to the winning indicia, the ticket holder presents the ticket to a lottery official. The lottery official in turn removes the scratch-off coating from the second set of play indicia. The second set should have indicia identical with the visible first set. If the two sets of indicia are the same and match the winning indicia, the ticket is valid and entitles the ticket holder to a prize. If, however, the second set of indicia is not the same as the first visible set, this indicates that someone has tampered with the visible set of play indicia in an attempt to forge a winning ticket.

Another type of validation system uses validation codes which are related to but not identical with the play indicia. In one such system, the validation code is created as the result of an algorithm which uses the play indicia as part of the creation process for the validation code. The resulting validation codes do not bear any apparent relationship to the play indicia. U.S. Pat. No. 4,725,079 discloses a lottery ticket in which the book number indicating the ticket lot is algorithmically converted into the validation number. U.S. Pat. No. 4,191,376 discloses a lottery ticket in which a validation code is simply a serial number which records information about the ticket, such as ticket lot number or distribution area, in numerical form. An algorithm is used to transform the serial number into the lottery number or play indicia. There is no apparent relationship between the serial number and the algorithmically generated lottery number so that one cannot tell if a ticket has winning play indicia by reference only to the serial number. Other validation systems use validation codes which, although related to the winning indicia, do not employ as sophisticated an algorithm for generating the validation code.

In all lottery tickets which use validation codes, the validation code provides separate verification of the status of the ticket. The actual method for verifying the status of the ticket varies with the type of validation system used. U.S. Pat. No. 4,398,708 discloses a verification method in which a computer is used to verify the play indicia and validation code of a given ticket. The ticket agent inputs the apparently winning lottery number into the computer along with the serial number which appears on the ticket. By reverse operation of the original algorithm which generated the lottery number from the serial number, the computer calculates the serial number which should be associated with the winning lottery number. The lottery ticket is verified as a winning ticket if the calculated serial number is identical with the serial number on the ticket. Alternatively, as disclosed in U.S. Pat. No. 4,398,708, after reverse-generating the serial number, the computer may simply generate an output indicating "yes" if the inputed lottery number and serial number correspond with a winning number and ticket. A computer based validation system is most appropriate with high value lottery games. For lower value prizes, the ticket agent may verify the ticket by comparing the validation code to a list of winning validation codes.

Regardless of the specific type of validation system used, a ticket must therefore have both winning play indicia and a proper validation code to qualify as a winning ticket. Falsification of the validation code, however, is possible if the ticket holder has access to the list of qualifying validation codes. Removable opaque layers covering the validation codes have been developed to prevent this type of fraudulent practice. The removable opaque layer helps to prevent both the examination of the validation code prior to ticket redemption and alterations of the validation code. U.S. Pat. Nos. 4,591,190, 4,174,857, and 4,726,608 disclose lottery tickets in which the validation code is concealed with a removable opaque layer. U.S. Pat. No. 4,591,190 discloses a removable opaque layer consisting of an opaque ultraviolet-cured ink. U.S. Pat. No. 4,726,608 discloses a removable opaque concealing layer consisting of a latex resin containing an ink and metal particles. U.S. Pat. No. 4,174,857 discloses a concealing layer consisting of cellulose acetate and latex. The removable opaque layer concealing the validation codes helps to prevent the inspection of the validation code prior to ticket redemption. If an individual has access to the list of validation codes corresponding to winning play indicia, or has access to the algorithm used to create the validation code from other known parameters, then the individual could pick out the winning tickets by merely examining the validation code. Removable opaque layers concealing the validation codes help to prevent this type of pre-selection of winning tickets.

The opaque layer is frequently overprinted with a legend such as "void if removed." U.S. Pat. No. 4,591,190 discloses a "void if removed" legend printed over the removable opaque layer concealing the validation code. The legend also includes line patterns which extend beyond the removable layer to the surface of the substrate. The "void if removed" legend indicates to the ticket holder that the covering should not be removed by the ticket holder. The legend also assists the ticket agent in determining whether the validation code has been altered. An unscrupulous person may attempt to remove the opaque covering and alter the validation code. Before presenting the forged ticket to the ticket agent for prize redemption, the opaque layer covering the validation code must be replaced. Distortion of the "void if removed" legend or other symbols printed on this opaque covering occurs during removal and replacement of the layer and indicates to the ticket agent that someone has tampered with the validation number. In addition, removal and replacement of the opaque layer frequently changes the layer such that it becomes very stiff and is not easily removed a second time. This change in the removal characteristics of the opaque layer also assists ticket agents in determining whether someone has tampered with the validation code.

Opaque layers covering the validation code do not, however, prevent all types of ticket falsification. The opaque covering helps to prevent fraudulent practices by lottery customers. The opaque covering does not adequately prevent fraudulent practices by lottery ticket agents. Prior to the sale of the ticket, the agent may remove the opaque layer covering the validation code to determine if a given ticket has a winning status. If the ticket does have a winning status, the agent retains the ticket himself and does not sell it to the public. If, on the other hand, the ticket is a loser, the agent simply replaces the opaque layer before sale to a customer. The opaque layer, once removed, can be stiffened by glue and then replaced by gluing it on the ticket. An opaque layer treated in this fashion becomes very stiff and is almost impossible to remove. If the lottery agent himself is responsible for removing and replacing the opaque covering, this type of fraudulent practice would not be detected. The agent would only replace the validation codes on losing tickets. Losing tickets in turn are not presented to lottery officials for verification of the validation code. Consequently, removal and replacement of the opaque covering on losing validation codes by unscrupulous ticket agents is largely undetected.

SUMMARY OF THE INVENTION

It is, therefore, an object of the present invention to enhance the security of instant lottery tickets by printing validation data in a developable invisible ink capable of being rendered visible by application of a developing agent. As used herein, an invisible ink is one which cannot be visually detected. The reaction rendering the ink visible is preferably irreversible, so that once developed, the validation data is permanently visible. The validation data requires a specific developing agent depending on the composition of the developable ink. To be able to develop the validation data, an individual would need to know both the type of developable ink used and the specific developing agent required. These facts would not be widely known, thus the use of a developable invisible validation data prevents access to the validation data by the public at large. Moreover, even if an individual had access to the types of ink and the required developing agent, the use of a developable invisible ink which is irreversibly rendered visible to print the validation data still prevents fraudulent access to the validation data. Development of this type of invisible inks would be irreversible thus providing permanent evidence of tampering with the validation data. The permanently visible developed validation data in turn prevents the fraudulent sale of losing lottery tickets by providing the consumer with an indication that someone has tampered with the ticket.

The use of validation data printed in developable invisible ink also facilitates easy validation of winning tickets. The invisible validation data is rendered visible by application of a developing agent which, in turn, can be applied in a simple manner, such as by a pen. Thus, game tickets using this type of validation data can be validated instantly without using elaborate equipment. Additionally, the use of invisible validation data can replace currently used validation codes that are subject to alteration by consumers or sales agents.

DETAILED DESCRIPTION OF THE INVENTION

Figure 1:
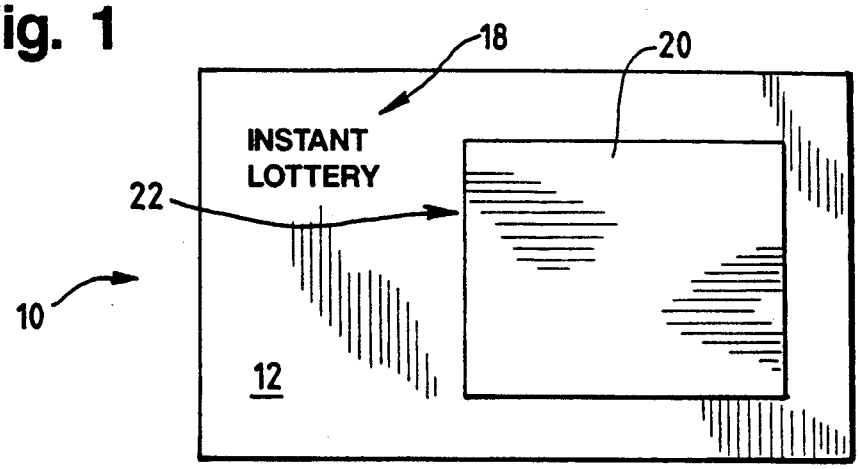
FIG. 1 is a plan view of a lottery ticket in accordance with the invention showing one embodiment of a lottery ticket with concealed play indicia in the form it would be sold to a consumer. Invisible validation instructions are printed in close proximity to the play indicia and are covered by the same removable opaque layer which covers the play indicia.
Figure 2:
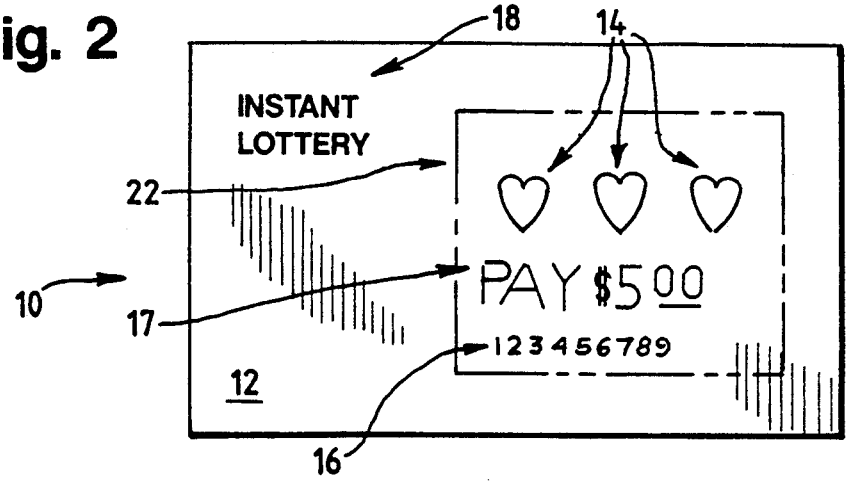
FIG. 2 is a top view of the ticket in FIG. 1 after the removable opaque layer covering the play indica has been removed.
Figure 3:
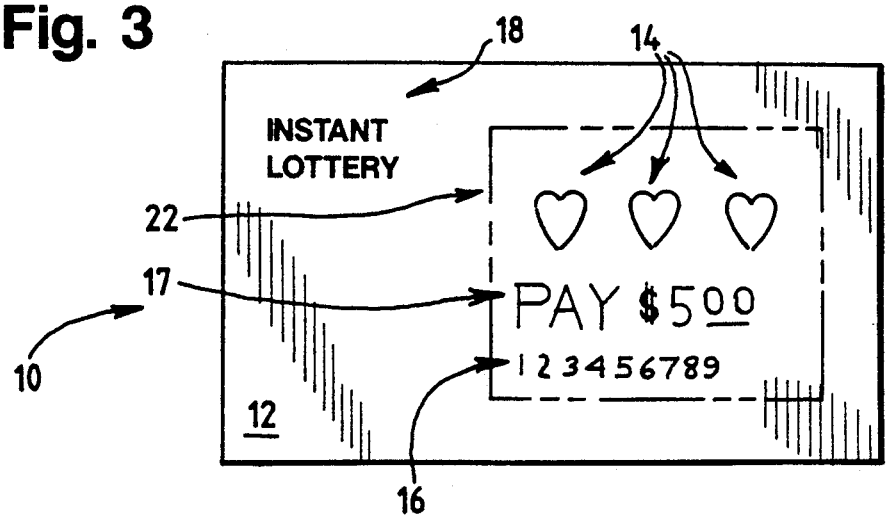
FIG. 3 is a top view of the lottery ticket in FIG. 2 after the invisible validation instructions have been rendered permanently visible by the application of an appropriate developing agent.

Referring to FIGS. 1-3, an instant lottery ticket 10 according to the preferred embodiment of the invention is shown. It should be understood that although the invention is being described in terms of an instant lottery ticket 10, the invention applies to other applications such as game tickets used in promotional games. The lottery ticket 10 includes a substrate 12 on which play indicia 14 and a validation number 16 are printed. The validation number 16 is typically a game wide unique number which can be verified against the lottery's complete list of winning validation numbers to assure authenticity of the ticket. The ticket 10 also contains invisible validation data, specifically the validation instructions 17, printed in invisible ink and illustrated here by the dotted line reading "PAY $5 00". These validation instructions 17 can replace the conventional human readable validation codes found on conventional instant tickets which can be altered by the player along with the play data in an attempt to claim an altered ticket. Other printed information 18, such as the name of the lottery game or the game rules, may also be printed on the substrate 12. In FIG. 1 the play indicia 14, validation number 16, and validation instructions 17 are not shown because they are concealed by a removable opaque layer 20, which is removed by the ticket holder as illustrated in FIGS. 2 and 3. The dashed line surrounding the play indicia 14, validation number 16 and validation instructions 17 in FIGS. 2 and 3 need not actually be printed on the substrate 12: the dashed line is shown only for clearer illustration of the play area 22 of the ticket 10 which contains the play indicia 14, validation number 16 and validation instructions 17.

FIG. 1 illustrates one embodiment of the ticket 10 in the form in which it would be sold to a lottery customer. The play indicia 14, the validation number 16, and the invisible validation data, specifically validation information 17, are concealed from the ticket purchaser and sales agent by the removable opaque layer 20. FIG. 2 illustrates the form of the ticket 10 after the ticket holder has removed the opaque layer 20. The play indicia 14 and validation number 16 are clearly visible. But the validation instructions 17 are still invisible as they have not yet been developed by an appropriate developing agent. FIG. 3 illustrates the form of the lottery ticket 10 after it has been presented to a ticket agent for redemption and the ticket agent has developed the validation instructions 17. After application of an appropriate developing agent, the validation instructions 17 are permanently visible on the ticket 10.

The substrate 12 may be composed of a single material such as card stock suitable for printed applications. The substrate 12 may also consist of a plurality of layers adapted to prevent certain types of fraudulent practices. For example, the substrate 12 could have an opaque foil layer (not shown) affixed to the side of the substrate 12 opposite the location of the play indicia 14 and the validation number 16 or sandwiched into the middle of the card stock. An opaque foil base layer helps to prevent the revealing of play indicia 14 by shining a light through the lottery ticket 10. Alternatively, a black opaque ink could be printed over the entire back surface of the substrate 12 to prevent the revealing of the play indicia 14 by shining a light through the lottery ticket 10. The substrate 12 may also have a patterned layer of material (not shown), a so-called confusion pattern, affixed to the top surface of the substrate 12 and positioned to underlie the play indicia 14. Confusion patterns help to prevent the revealing of the concealed play indicia 14 by shining a light through the lottery ticket 10 or by photocopying the lottery ticket 10.

The play indicia 14 can consist of numbers, letters, symbols, or combinations thereof. As shown in FIGS. 2 and 3, the play indicia 14 consist of symbols, in this case three hearts. The play indicia 14 may be printed on the lottery ticket 10 using various printing means known in the art. For example, the play indicia 14 could be lithographed onto the substrate 12 or the play indicia 14 could be printed on substrate 12 by a computer-controlled ink jet printer. A variety of ink compositions known in the art may be used to print the play indicia 14. For example, the play indicia 14 may be printed with a water based, water soluble ink. Similarly, as illustrated in FIGS, 1-3, the validation number 16 may be printed using conventional, visible inks. The validation number 16 may be printed on the lottery ticket using various printing means known in the art.

The removable opaque layer 20 is affixed to the lottery ticket 10 to conceal the play indicia 14 and the validation number 16. The area below the opaque layer 20, within which the play indicia 14, the validation number 16, and the invisible validation data such as validation instructions 17 are printed is the play area 22 of lottery ticket 10. The opaque layer 20 may consist of various types of removable materials which are well known in the art. For example, the opaque layer 20 may consist of a removable paper tag. Alternatively, the opaque layer 20 may consist of a latex resin. The opaque layer 20 may also contain fugitive dyes. A fugitive dye is one which is not colorfast and bleeds when exposed to certain solvents. Providing the opaque layer 20 with a fugitive dye helps to prevent fraudulent removal of the opaque layer 20. If an individual attempts to remove the opaque layer 20 in a single piece by applying a solvent to the opaque layer 20, fugitive dyes within the opaque layer 20 will bleed out and stain the surrounding substrate. Fugitive dyes in the opaque layer 20 can thus provide a permanent indication that someone has attempted to tamper with the opaque layer 20.

The invisible validation data such as validation instructions 17 are printed on the substrate 12 with a developable invisible ink. The developable ink of this invention is the material actually used to print the validation instructions 17 on the substrate 12 and need not be an ink in the conventional sense. The validation instructions 17 may be printed with developable invisible ink on the substrate 12 using various printing means known in the art. For example, the validation instructions 17 could be lithographed onto the substrate 12 or the validation instructions 17 could be printed on the substrate 12 by a computer controlled ink jet printer.

Numerous invisible ink compositions are known in the art. For example, one invisible ink is based on the oxidation of iodide to iodine in the presence of a material which reacts with the iodine to produce an intensely colored product. U.S. Pat. No. 3,788,863 discloses an invisible ink in composition based on this oxidation reaction of iodide. Such a developable ink in accordance with the present invention would consist of a material containing a substance capable of oxidizing iodide. Soluble metal salts, such as the chloride, nitrate, sulfate, acetate, lactate, benzoate, or stearate of copper, which can oxidize iodide to iodine and which are colorless in solution can be used as the basis for the developable invisible ink. The developing agent, which is applied to the invisible validation instructions 17 to render the validation instructions 17 permanently visible, contains the source of iodide. The iodide source can be a material which is colorless when used in solution, such as ammonium iodide or potassium iodide. Alternatively, the iodide source can be a colored iodide salt since the iodide source is not applied to the validation instructions 17 until the validation instructions 17 are developed. The third component necessary for this type of invisible ink composition, a substance capable of reacting with the released iodine to form a highly colored product, may be present either in the invisible ink or in the developing agent. Suitable materials for the third component include substances such as starch.

U.S. Pat. No. 3,823,022 discloses another invisible ink composition which is based on the reaction of a Lewis acid with a leuco dye intermediate to form a highly colored product. Lewis acids are substances having a high electron affinity evidenced by a tendency to act as an electron acceptor. For example, organic substances having highly polar groups such as carboxyl groups, ketone groups, nitro groups, or halogen groups are generally Lewis acids. Other types of Lewis acids include some inorganic acids, heteropoly acids, substituted amines, oximes, imides and diazo compounds. Leuco dye intermediates are colorless intermediate dyes which can function as electron donors in reacting with a Lewis acid and yielding a colored product. A variety of leuco dye intermediates are known and include substances such as the n-phenyl derivatives of leuco auramine. An invisible ink based on this composition and in accordance with the present invention may contain a colorless Lewis acid. The developing agent appropriate for this invisible ink would then contain a leuco dye intermediate. Alternatively, an invisible ink in accordance with this invention may contain a leuco dye intermediate and the developing agent would then contain a Lewis acid.

Other types of invisible inks are possible and this invention is not limited to the foregoing examples. There are two important characteristics of an invisible ink in accordance with this invention: the ink used to print the invisible validation data, such as the validation instructions in ticket 10, on the substrate 12 must be invisible and stable in its invisible form; and the ink must react with a developing agent to yield a visible image. Any ink composition with these characteristics is in accordance with this invention. In this application it is preferable that the ink reacts irreversibly with the developing agent thus providing a permanent indication that the invisible information has been developed. The concept of irreversibility as used in this invention does not necessarily encompass only those inks, if any, which are bleach proof. Invisible inks capable of being irreversibly rendered visible in accordance with this invention may be susceptible to bleach and thus capable of being "erased" by the use of an appropriate bleaching agent. In this application it is also preferable that the invisible ink is highly secure against agent pick-out using such means as on light, chemical wicking onto a secondary paper sheet and then developing the secondary sheet, reversible reactions, etc., to prevent the sales agent from being able to pick out the winners.

Ticket 10 provides at least two means for preventing fraudulent access to the validation number 16 and validation instructions 17. First, before the validation instructions 17 can be developed, the opaque layer 20 must be removed thus providing an indication that someone has tampered with the ticket 10. Second, even after the opaque layer 20 is removed, the validation instructions 17 are still invisible. A person attempting to fraudulently access the validation instructions 17 to determine if the ticket 10 is a winning ticket would have to develop the validation instructions 17 by applying a suitable developing agent. However, a sales agent would not pay a ticket presented by a customer where the validation instructions 17 were already developed. Fraudulent access to the validation instructions 17 is thus a futile effort.

Invisible validation data such as validation instructions 17 provide additional advantages. The developing agent used to render the validation instruction 17 visible can be applied by using simple techniques, such as a pen. There is no need to use elaborate equipment to validate a winning ticket. And since the validation instructions 17 are rendered visible, preferably irreversibly visible, by the developing agent, the sales agent does not have to take any other action to void a ticket once it is paid. In addition, invisible validation instructions 17 prevent the presentation of altered tickets to sales agents for payment. A non-winning ticket would contain invisible validation instructions 17 indicating that the ticket did not win a prize. Thus even though the player may have created an apparently winning ticket, the invisible validation instructions 17, when developed by the sales agent, would indicate that the ticket was not a valid winning ticket.

Figure 4:
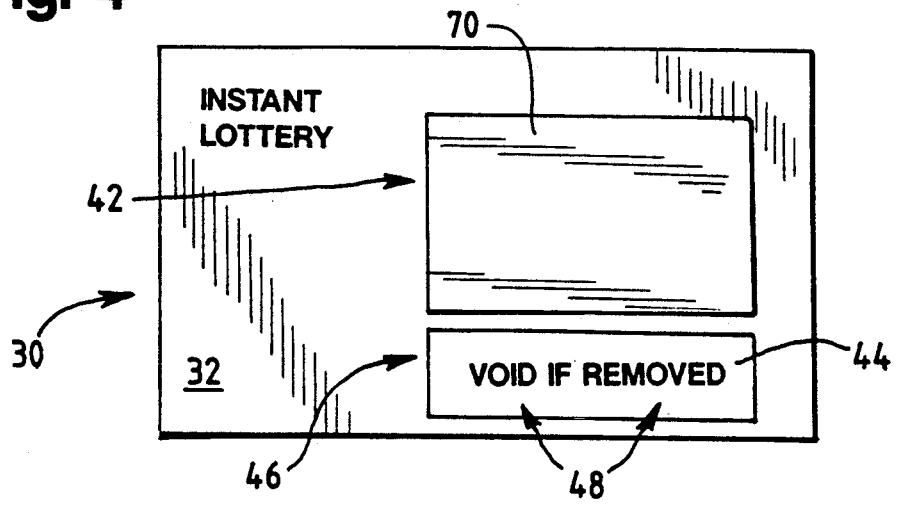
FIG. 4 is a plan view of a lottery ticket in accordance with the invention showing another embodiment of a lottery ticket with concealed play indicia in the form it would be sold to a consumer. The ticket in FIG. 4 differs from that in FIGS. 1-3 in that the invisible validation number and instructions are covered with a separate removable opaque layer.
Figure 5:
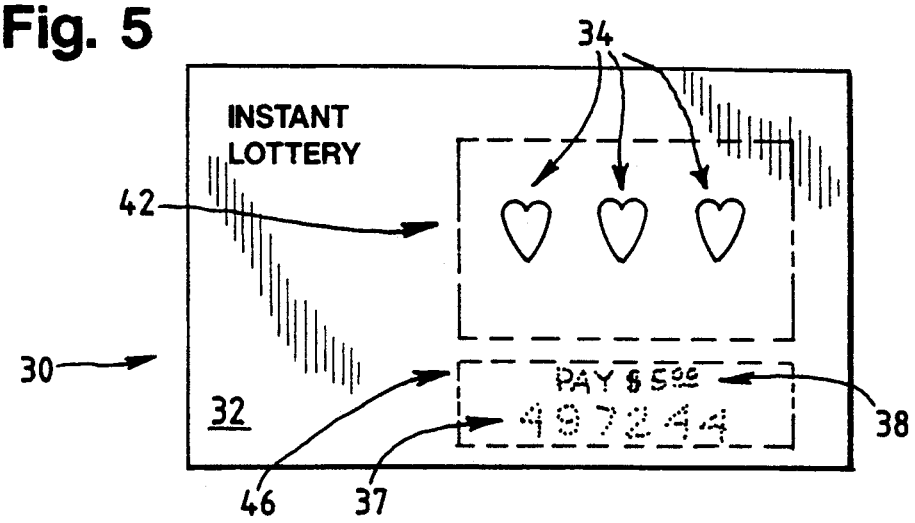
FIG. 5 is a top view of the ticket in FIG. 4 after the removable opaque layer covering the play indica has been removed.
Figure 6:
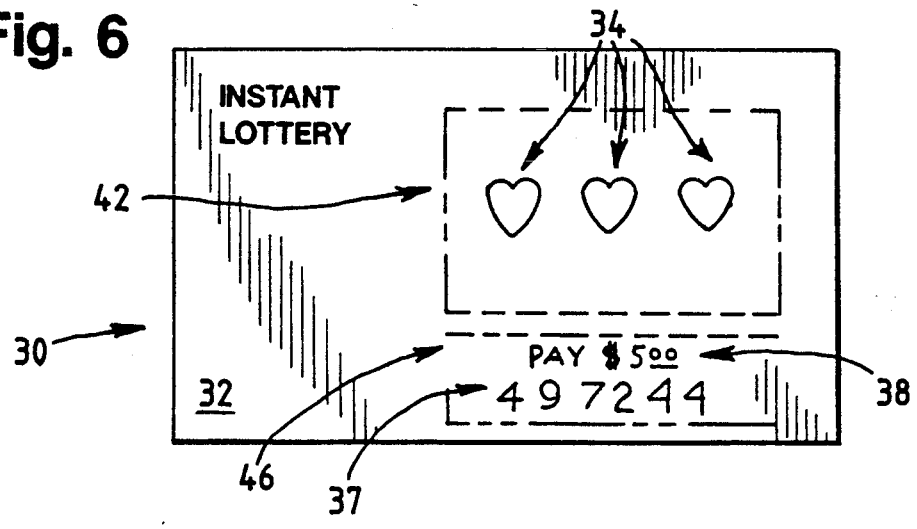
FIG. 6 is a top view of the lottery ticket in FIG. 5 after the invisible validation data have been rendered permanently visible by the application of an appropriate developing agent.

FIGS. 4–6 illustrate a second embodiment of a lottery ticket 30 in accordance with the present invention. The lottery ticket 30 has a substrate 32, play indicia 34, invisible validation data including a validation number 37 and an agent validation instruction 38, a removable opaque layer 40 and a play area 42 which are analogous to the substrate 12, the play indicia 14, the agent validation instructions 17, the printed material 18, the removable opaque layer 20 and the play area 22 of the lottery ticket 10 illustrated in FIGS. 1-3.

Ticket 30 differs from ticket 10 in three ways. In contrast to ticket 10, the validation number 37 of ticket 30 is printed in invisible ink. Thus, for ticket 30, the invisible validation data consists of both the validation instructions 38 and the validation number 37. Second, unlike ticket 10, the validation data, including the validation number 37 and the validation instructions 38, are printed on the substrate 32 in a location distinct from the play area 42. Specifically, the invisible validation data, including the validation number 36 and the validation instructions 38, are printed within the validation area 46 of lottery ticket 30. Third, lottery ticket 30 has a separate removable layer 44 overlying the validation area 46. The opaque layer 46 may consist various types of removable materials well known in the art and may also contain fugitive dyes.

A legend 48 may be printed on the surface of the opaque layer 44. The legend 48 may consist of the phrase "void if removed", as illustrated in FIG. 4. The legend 48 may also contain a pattern marking, such as lines (not shown). The legend 48 helps to prevent and detect the fraudulent removal of the opaque layer 44. If an unscrupulous person tries to remove the opaque layer 44 in an attempt to determine the validation information 36 and then replaces the opaque layer 44, misalignment of the legend 48 provides an indication of that tampering.

The lottery ticket 30 may contain a release coat (not shown) immediately overlying the invisible validation data. Release coats are well known in the art and help to improve the removal characteristics of removable layers such as the opaque layer 44. Release coats generally comprise a substance to which a second substance, such as the opaque layer 44, has only limited adhesion. In practice, release coats are formulated so the layer to be removed is less adhesively bound to the release coat than it is to the ticket substrate, such as the substrate 32. In the present invention, the opaque layer 44 may overlie such a release coat and be affixed to the substrate 32. If a release coat is used, the release coat must permit the development of the invisible validation data such as validation number 36 and validation instructions 38 by a developing agent. This goal can be achieved if the release coat is in some way permeable to the developing agent. For example, the developer may be soluble in the release coat such that it permeates the release coat and activates the invisible ink. Or, a release coat may be used which, even though applied in a continuous layer overlying the invisible validation data, results in discontinuous layer, such as a honeycomb. The discontinuities in the release coat layer permit the developing agent to contact the validation data thus facilitating the development of the validation information 37 and 38 into a permanently visible image.

FIG. 4 illustrates the lottery ticket 30 in the form in which it would be sold to a lottery consumer. Neither the play indicia 34 nor the invisible validation data is shown in FIG. 4 because these elements are covered by the removable opaque layers 40 and 44 respectively. The legend 48 overlies the opaque layer 44 and indicates to the ticket purchaser that this layer is not to be removed. FIG. 5 illustrates the lottery ticket 30 as it appears after the opaque layers 40 and 44 have been removed. The play indicia 34, which in this case consist of three hearts, are clearly visible. The invisible validation data, consisting of the validation number 37 and the validation instructions 38 are not yet visible because they have not been developed by application of an appropriate developing agent, and so are illustrated in dotted lines in FIG. 5. FIG. 6 illustrates the form of the lottery ticket 30 after the opaque layers 40 and 44 have been removed, and after the invisible validation data have been developed. The validation data, including the validation number 37 and the validation instructions 38, are now permanently visible on the lottery ticket 30.

Note that on ticket 30 the invisible validation data 37 and 38 consists of both the unique validation number 37 and the agent validation instructions 38. It would not be necessary to print the validation number 37 in invisible ink since this number is typically used only at lottery headquarters and not by the agent. Since both the validation number 37 and the validation instructions 38 are covered by the removable opaque layer 44 no security problems would arise in printing the validation number 37 in a standard human-readable ink.

Figure 7:
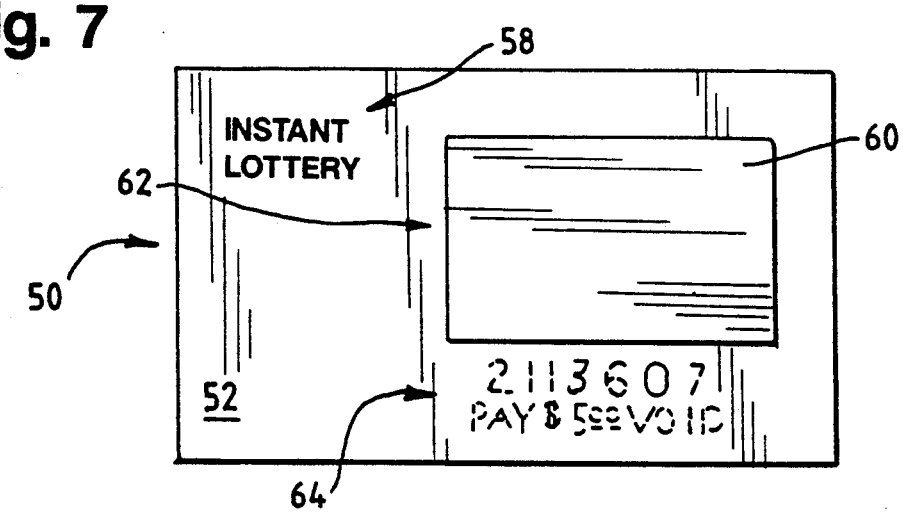
FIG. 7 is a plan view of a lottery ticket in accordance with the invention showing yet another embodiment of a lottery ticket with concealed play indicia in the form it would be sold to a consumer. The ticket in FIG. 7 differs from the ticket in FIGS. 1-3 and from the ticket in FIGS. 4-6 in that the invisible validation data are printed at a separate location from the play indicia and is not covered by a removable opaque layer.
Figure 8:
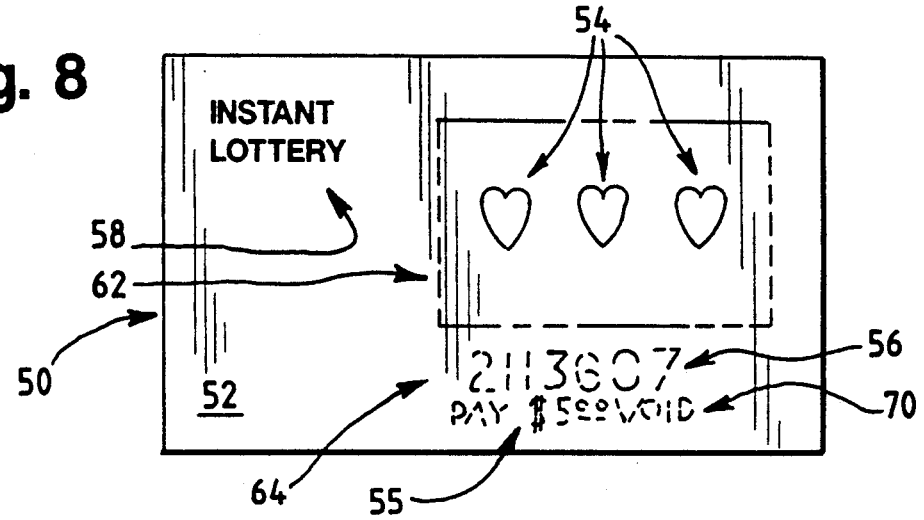
FIG. 8 is a top view of the ticket in FIG. 7 after the removable opaque layer covering the play indica has been removed.
Figure 9:
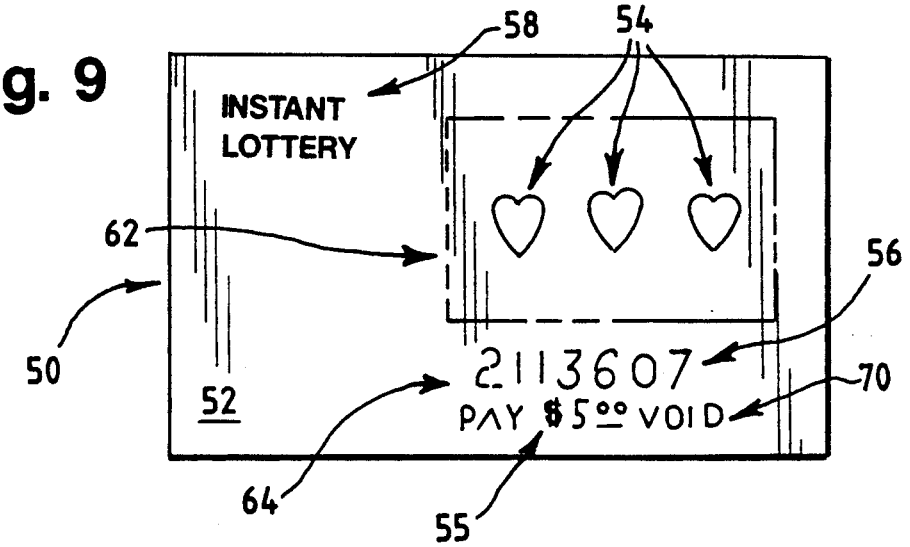
FIG. 9 is a top view of the lottery ticket in FIG. 8 after the invisible validation data have been rendered permanently visible by the application of an appropriate developing agent.

FIGS. 7-9 illustrate another embodiment of a lottery ticket 50 in accordance with the present invention. The lottery ticket 50 has a substrate 52, play indicia 54, validation instructions for the agent 55, a validation number 56, other printed material 58, a removable opaque layer 60 and a play area 62 which are analogous to the substrate 12, the play indicia 14, the validation number 16, the validation instructions 17, the printed material 18, the opaque layer 20, and the play area 22 of the lottery ticket 10 illustrated in FIGS. 1-3. The ticket 50 differs from the ticket 10 in three ways. In contrast to ticket 10, the validation number 56 of ticket 50 is printed in invisible ink. Second, unlike ticket 10, the validation data, including the validation number 56 and the validation instructions 55, are printed on the substrate 52 in a location distinct from the play area 42, specifically, within the validation area 64 of the ticket 50. Third, because the validation data of ticket 50 are not printed within the play area 62, they are not covered by the removable layer 60 which is affixed to the ticket 50 over the play area 62. The ticket 50 differs from the ticket 30 in that the ticket 50 does not have a separate removable layer affixed to the ticket 50 over the validation area 64. The ticket 50 differs from both the ticket 10 and the ticket 30 in that the ticket 50 also has a void legend 70, consisting of the word "VOID", printed in invisible ink. Thus, for ticket 50, the invisible validation data includes the validation instructions 55, the validation number 56, and the void legend 70.

FIG. 7 illustrates the lottery ticket 50 in the form in which it would be sold to a consumer. The play indicia 54 are not shown in FIG. 7 as they are concealed by the opaque layer 60. The invisible validation data, including the validation instructions 55, the validation number 56, and the void legend 70, are also not visible to the consumer because they are printed in invisible ink. Consequently, the validation instructions 55, the validation number 56, and the void legend 70 are shown in FIG. 8 as dotted lines to indicate that they are invisible.

FIG. 8 illustrates the form of the lottery ticket 50 after the opaque layer 60 has been removed. The play indicia 54, consisting of symbols, is clearly visible. The validation instructions 55, and number 56 are not yet visible because they have not yet been developed by application of a suitable developing agent. Similarly, the void legend 70 is undeveloped and so is drawn in dotted lines.

FIG. 9 illustrates the form of the lottery ticket 50 after the opaque layer 60 has been removed and after the validation number 56, instructions 55 and void legend 70 have been developed. Both the validation number 56 and the validation instructions 55 are visible. Application of a developing agent to the validation data 55, 56 renders the validation data 55, 56 visible, as shown in FIG. 9. The developing agent also renders the void legend 70 visible. Validation data 55, 56 and void legend 70 are preferably irreversibly rendered visible by application of the developing agent. The void legend 70 thus provides added assurance that a ticket purchaser will notice that someone has tampered with the ticket 50 and so will not purchase the ticket 50 in its developed state.

What is claimed is:

1. A game ticket comprising:
a substrate adapted to be printed thereon;
a play area located on said substrate;
play indicia printed on said substrate;
a removable layer affixed to the game ticket over said play area; and
validation data printed on said substrate in a developable invisible ink capable of being rendered visible by application of a developing agent.

2. The ticket in claim 1 wherein at least a portion of said validation data are printed within said play area.

3. The ticket in claim 2 wherein said ticket further includes a permeable release coat overlying said validation data.

4. The ticket in claim 1 wherein said validation data is printed on said substrate by a computer controlled ink jet printer.

5. The ticket in claim 1 wherein said validation data is printed on said substrate by lithography.

6. The ticket in claim 1 wherein validation data ink is irreversibly rendered visible by application of said developing agent.

7. The ticket in claim 1 wherein said validation data ink contains an oxidizing agent, said ink being irreversibly rendered visible by application of said developing agent containing an iodide.

8. The ticket of claim 1 wherein said validation data ink contains a Lewis acid, said ink being irreversibly rendered visible by application of said developing agent containing a leuco-dye intermediate.

9. The ticket in claim 1 wherein said validation data ink contains a leuco-dye intermediate, said ink being irreversibly rendered visible by application of said developing agent containing a Lewis acid.

10. The ticket in claim 1 wherein said validation data includes validation instructions.

11. The ticket in claim 10 wherein said validation data further includes a validation number.

12. The ticket in claim 11 wherein said validation, data includes a void legend.

13. The ticket in claim 12 wherein said ticket further includes a validation area distinct from said play area wherein at least a portion of said validation data is printed within said validation area.

14. The ticket in claim 13 wherein said ticket further includes a removable layer affixed to said ticket over said validation area.

15. The ticket in claim 14 wherein said ticket further includes a permeable release coat overlying said at least a portion of said validation data printed in said validation area.

16. The ticket in claim 11 wherein at least a portion of said validation data is printed within said play, area.

17. The ticket in claim 16 wherein said ticket further includes a permeable release coat overlying at said portion of said validation data within said play area.

18. A game ticket comprising:
a substrate adapted to be printed thereon;
a play area located on said substrate;
play indicia printed on said substrate;
a removable layer affixed to the game ticket over said play area; and
validation instructions printed on said substrate in a developable invisible ink capable of being rendered visible by application of a developing agent.

19. The ticket in claim 18 wherein said validation instructions are printed on said substrate by a computer controlled ink jet printer.

20. The ticket in claim 18 wherein said validation instructions are printed on said substrate by lithography.

21. The ticket in claim 18 wherein said validation instructions ink is irreversibly rendered visible by application of a developing agent.

22. The ticket in claim 18 wherein said validation instructions include a developable invisible ink containing an oxidizing agent, said ink being irreversibly rendered visible by application of an iodide-containing developing agent.

23. The ticket of claim 18 wherein said validation instructions include a developable invisible ink containing a Lewis acid, said ink being irreversibly rendered visible by application of a leuco-dye intermediate containing developing agent.

24. The ticket in claim 18 wherein said validation instructions include a developable ink containing a leuco-dye intermediate, said ink being irreversibly rendered visible by application of a Lewis acid containing developing agent.

25. The ticket in claim 18 wherein said validation instructions are printed within said play area beneath said removable layer.

26. The ticket in claim 25 wherein said ticket further includes a permeable release coat overlying said validation instructions.

27. The ticket in claim 25 wherein said ticket further includes a validation number printed within said play area.

28. The ticket in claim 18 wherein said ticket further includes a validation area located on said substrate, distinct from said play area and said validation instructions are printed within said validation area.

29. The ticket in claim 28 wherein said ticket further includes a removable layer affixed to said ticket over said validation area.

30. The ticket in claim 29 wherein said ticket further includes a permeable release coat overlying said validation instructions.

31. The ticket in claim 28 wherein said ticket further includes a validation number printed within said validation area.

32. A method for producing a game ticket having a substrate comprising the steps of:
printing play indicia on said ticket substrate within a specific play area location on the substrate;

attaching a removable layer to the game ticket over the play indicia; and printing the ticket substrate with validation data using a developable invisible ink capable of being rendered visible by applying a developing agent.

33. The method in claim 32 wherein said developable invisible ink is irreversibly rendered visible by application of said developing agent.

34. The method in claim 32 wherein said developable invisible ink contains an oxidizing agent is capable of being irreversibly rendered visible by applying an iodide-containing developing agent.

35. The method in claim 32 wherein said developable invisible ink contains a Lewis acid is capable of being irreversibly rendered visible by applying a leuco-dye intermediate containing developing agent.

36. The method in claim 32 wherein said developable ink contains a leuco-dye intermediate and is capable of being irreversibly rendered visible by applying a Lewis acid containing developing agent.

37. The method in claim 32 wherein said step of printing the validation data includes using a computer controlled ink jet printer.

38. The method in claim 32 wherein said step of printing the validation data includes using lithography.

39. The method in claim 32 further including the step of applying a permeable release coat over the validation data.

40. The method in claim 39 further including the step of attaching a removable layer to the ticket over the permeable release coat.

41. A method for producing a game ticket having a substrate comprising the steps of:

printing play indicia on said ticket substrate within a specific play area location on the substrate;

attaching a removable layer to the game ticket over said play indicia;

printing validation data on said ticket substrate, said printing including using a developable invisible ink capable of being rendered visible by applying a developing agent;

applying a permeable release coat to the game ticket over said validation data; and attaching a removable layer to the game ticket over said validation data.

42. The method in claim 41 wherein said validation data ink is irreversibly rendered visible by application of said developing agent.

43. The method in claim 41 wherein said developable invisible ink contains an oxidizing agent and is capable of being irreversibly rendered visible by applying an iodide-containing developing agent.

44. The method in claim 41 wherein said developable invisible ink contains a Lewis acid and is capable of being irreversibly rendered visible by applying a leuco-dye intermediate containing developing agent.

45. The method in claim 41 wherein said developable ink contains a leuco-dye intermediate and is capable of being irreversibly rendered visible by applying a Lewis acid containing developing agent.

46. The method in claim 41 wherein said printing of the validation instructions includes using a computer controlled ink jet printer.

47. The method in claim 41 wherein said 20 printing of said validation instructions includes using lithography.

* * * * *